US006186562B1

(12) United States Patent
Huang

(10) Patent No.: US 6,186,562 B1
(45) Date of Patent: Feb. 13, 2001

(54) LATCH BOLT ASSEMBLY OF A LOCK

(75) Inventor: Lan-Shi Huang, Kaohsiung (TW)

(73) Assignee: Fu Hsing Industrial Co., Ltd, Kaohsiung (TW)

( * ) Notice: Under 35 U.S.C. 154(b), the term of this patent shall be extended for 0 days.

(21) Appl. No.: 09/325,381

(22) Filed: Jun. 4, 1999

(51) Int. Cl.[7] ..... E05C 1/12
(52) U.S. Cl. ..... 292/169; 292/337; 292/DIG. 64
(58) Field of Search ..... 292/1.5, 165, 169, 292/170, 337, DIG. 64

(56) References Cited

U.S. PATENT DOCUMENTS 4,687,239 * 8/1987 Lin ..... 292/172
4,718,706 * 1/1988 Fang ..... 292/337
4,850,626 * 7/1989 Gallego ..... 292/337
5,257,837 * 11/1993 Bishop ..... 292/1.5

FOREIGN PATENT DOCUMENTS 82243 11/1986 (TW) .

* cited by examiner

*Primary Examiner*—Gary W. Estremsky
(74) *Attorney, Agent, or Firm*—Bacon & Thomas, PLLC

(57) ABSTRACT

A latch bolt assembly of a lock includes a casing, a transmission device mounted in the casing, and a latch bolt device. The latch bolt device includes a latch bolt, a transmission member having a first end secured to the latch bolt to move therewith and a second end actuatable by the transmission device, and a reinforcing plate. The latch bolt including a cavity for receiving the first end of the transmission member. The reinforcing plate is inserted into cavity to fill a spacing between the transmission member and the latch bolt, thereby securely retaining the first end of the transmission member in the cavity of the latch bolt. A safety device is mounted juxtaposed to the latch bolt and is biased inward to a position to prevent retraction of the latch bolt when a door to which the lock is mounted is in a closed

14 Claims, 2 Drawing Sheets

LATCH BOLT ASSEMBLY OF A LOCK

BACKGROUND OF THE INVENTION

1. Field of the Invention

The present invention relates to a latch bolt assembly of a lock.

2. Description of the Related Art

Taiwan Utility Model Publication No. 82243, entitled "LATCH BOLT MECHANISM IMPROVEMENT OF A TUBULAR LOCK" and issued on Nov. 1, 1986, discloses a latch bolt mechanism that includes an outer casing assembly, a latch bolt assembly, and an arcuate transmission crank. The latch bolt assembly includes a latch bolt, an unlatching plate engaged with the latch bolt, and a latch bolt driving member. It is, however, found that engagement between the latch bolt and the unlatching plate is unreliable such that the latch bolt might be bent when subjected to a relatively large external force. As a result, the latch bolt assembly will be damaged and thus malfunction.

The present invention is intended to provide a latch bolt assembly to solve this problem.

SUMMARY OF THE INVENTION

In accordance with a first aspect of the invention, a latch bolt assembly of a lock comprises:

a casing;

a transmission device mounted in the casing; and a latch bolt device including a latch bolt, a transmission member having a first end with a hook thereon and a second end actuatable by the transmission device, and a reinforcing plate, the latch bolt including a cavity for receiving the first end of the transmission member, the latch bolt further including a side opening for engaging with the hook of the transmission member to thereby couple the latch bolt to the transmission member to move therewith, the reinforcing plate being inserted into the cavity to fill a spacing between the transmission member and the latch bolt, thereby securely retaining the first end of the transmission member in the cavity of the latch bolt.

In accordance with a second aspect of the invention, a latch bolt assembly of a lock comprises:

a casing;

a transmission device mounted in the casing; and a latch bolt device including a latch bolt, a transmission member having a first end engaged with the latch bolt to move therewith and a second end actuatable by the transmission device, wherein the transmission device further includes a safety means mounted juxtaposed to the latch bolt, wherein the safety means is biased inward to a position to prevent retraction of the latch bolt when a door to which the lock is mounted is in a closed position.

In a preferred embodiment of the invention, the safety means includes a safety rod mounted juxtaposed to the latch bolt, a burglarproof plate having a first end securely mounted in the casing and a second end with an arcuate portion, an unlatching plate having a first end connected to the safety rod to move therewith and a second end operably connected to the arcuate portion of the burglarproof plate, and an elastic member mounted between the safety rod and the burglarproof plate for biasing the safety rod out of the door and for biasing the second end of the burglarproof plate out of a retraction path of the latch bolt when the door is in an opened position. The second end of the burglarproof plate is biased to a position to prevent retraction of the latch bolt when the door is in the closed position.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
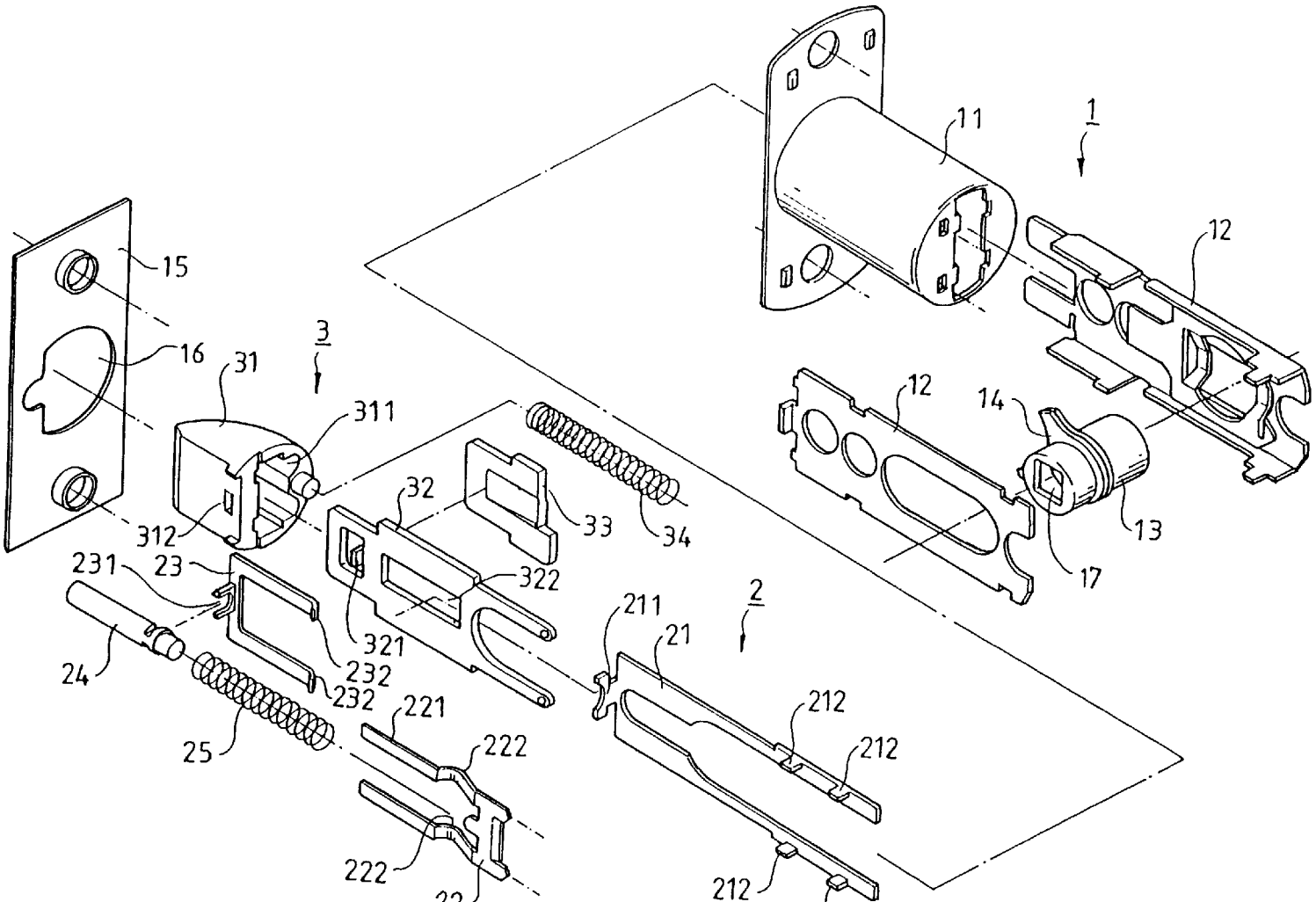
FIG. 1 is an exploded perspective view of a latch bolt assembly of a lock in accordance with the present invention.
Figure 2:
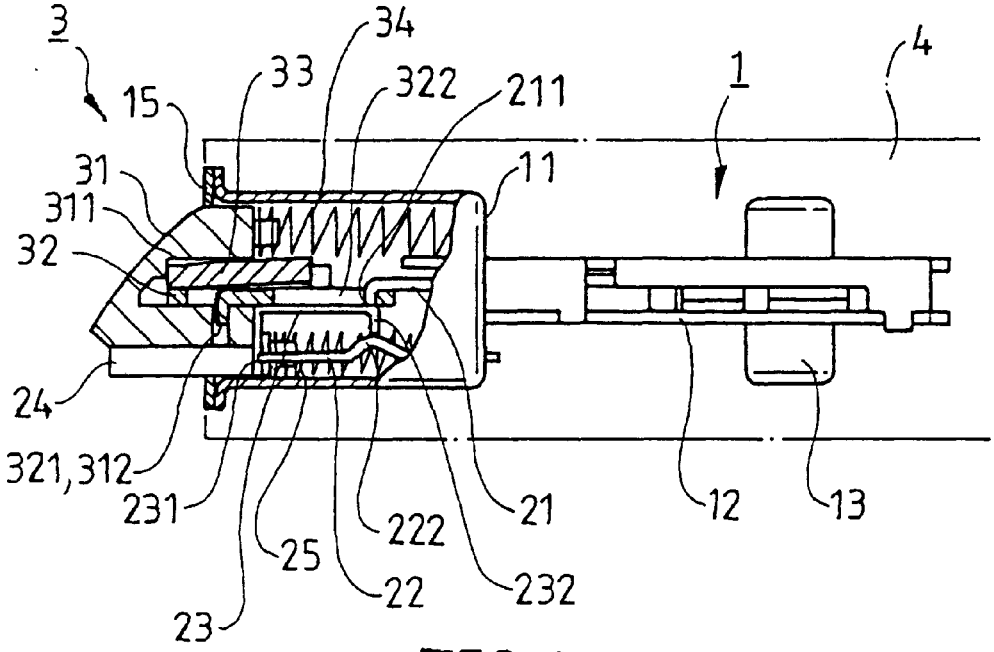
FIG. 2 is a sectional view of the latch bolt assembly in accordance with the present invention.

Referring to FIGS. 1 and 2, a latch bolt assembly for a lock in accordance with the present invention generally includes a casing device 1, a transmission device 2, and a latch device 3. The casing device 1 includes a cylindrical casing 11 for receiving the transmission device 2 and the latch bolt device 3, and a faceplate 15 is mounted to a front end of the casing 11 for restraining the transmission device 2 and the latch bolt device 3. The faceplate 15 includes an opening 16 through which a latch bolt 31 of the latch bolt device 3 is retractably extended, which is conventional and therefore not further described. Two backset plates 12 extend axially from a rear end of the casing 11, and a spindle (not shown) of the lock extends transversely through the backset plates 12 for driving a latch bolt extracting plate 21 of the transmission device 2. In this embodiment, a drive wheel 13 is rotatably held by the backset plates 12, and the spindle (not shown) of the lock extends through a rectangular hole 17 of the drive wheel 13 to rotate therewith. The drive wheel 13 includes teeth 14 for actuating the latch bolt extracting plate 21.

The transmission device 2 includes the latch bolt extracting plate 21, a burglarproof plate 22, an unlatching plate 23, and a safety bar 24. The latch bolt extracting plate 21 includes a hook 211 on an end thereof, the hook 211 being engaged with a transmission plate 32 for actuating the latch bolt 31. The other end of the latch bolt extracting plate 21 includes teeth 212 that are driven by the teeth 14 of the drive wheel 3 for moving the latch bolt extracting plate 21 in an axial direction away from the face plate 15 to thereby retracting the latch bolt 31. The burglarproof plate 22 includes an end attached to a bottom portion of an inner periphery of the casing 1. An elastic member 25 is mounted between the burglarproof plate 22 and the safety bar 24. The burglarproof plate 22 further includes two slant legs 221 each having an arcuate portion 222, which will be described later.

The unlatching plate 23 includes a hook 231 on an end thereof so as to be engaged with the safety bar 24. The other end of the unlatching plate 23 includes two legs (not labeled) each having a slanted distal end 232. When the unlatching plate 23 is moved by the safety bar 24, the slanted distal ends 232 is moved to engage with or disengage from the arcuate portions 222 of the burglarproof plate 22. More specifically, when the arcuate portions 222 of the burglarproof plate 22 are not in contact with the slanted distal ends 232 of the unlatching plate 23, the legs 221 of the burglarproof plate 22 is biased to a position that prevents retraction of the latch bolt 31. Thus, the burglarproof plate 22 prevents destruction of the lock by means of pressing the latch bolt 31 inwardly.

Figure 3:
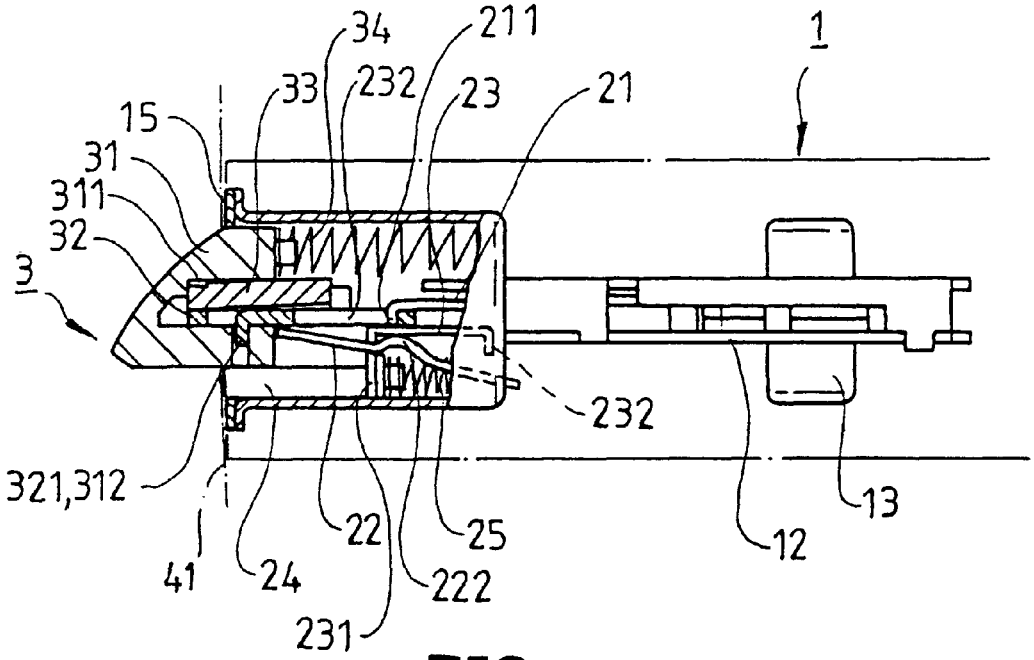
FIG. 3. is a sectional view similar to FIG. 2, wherein a door to which the latch bolt assembly is mounted is in a closed position

The safety bar 24 is provided juxtaposed to the latch bolt 31. The elastic member 25 mounted between the safety bar 24 and the burglarproof plate 22 biases the safety bar 24 to extend out of the face plate 15. Nevertheless, when a door 4 to which the latch bolt assembly is mounted is in a closed position (FIG. 3), the safety bar 24 is moved inward by a doorframe 41. As a result, the unlatching plate 23 is moved inward (rightward in FIG. 3) such that the slant distal ends 232 of the unlatching plate 23 disengage from the arcuate portions 222 of the burglarproof plate 22. Accordingly, distal ends of the legs 221 of the burglarproof plate 22 are moved to the position that prevents retraction of the latch bolt 31, thereby achieving the burglarproof function.

The latch bolt 31 includes a cavity 311 for receiving an end of the transmission plate 32. The end of the transmission plate 32 includes a hook 321 that extends through a side opening 312 in the latch bolt 31 such that the transmission plate 32 is coupled to the latch bolt 31 to move therewith. In order to provide a better positioning effect and convenient assembly between the transmission plate 32 and the latch bolt 31, a reinforcing plate 33 is inserted into a spacing in the cavity 311 after the end of the transmission plate 32 is inserted into the cavity 311 of the latch bolt 31. The reinforcing plate 33 is secured in place. In a preferred embodiment of the invention, the reinforcing plate 33 is inserted into the cavity 311 of the latch bolt 31 in a tight fitting manner to avoid disengagement between the reinforcing plate 33 and the transmission plate 32 and to provide a stronger structure to bear larger external impact. Thus, deformation of the latch bolt 31 and the transmission member 32 is avoided after assembly. The latch bolt 31 is biased out of the faceplate 15 by the elastic member 34. The transmission member 32 is coupled to the latch bolt 31 by the hook 321, as mentioned above. The transmission member 31 farther includes a slot 322 for engaging with the hook 211 of the latch bolt extracting plate 21. Thus, the latch bolt 31 is retracted via transmission of the transmission plate 32 when the latch bolt extracting plate 21 is moved inward.

Referring to FIG. 2, when a door 4 to which the latch bolt assembly is mounted is in an opened position, the safety bar 24 is biased out of the face plate 15 by the elastic member 25 while the latch bolt 31 is biased out of the face plate 15 by the elastic member 34.

Referring to FIG. 3, again, when the door 4 is in a closed position, the safety bar 24 is moved inward by the doorframe 41. As a result, the unlatching plate 23 is moved inward (rightward in FIG. 3) such that the slant distal ends 232 of the unlatching plate 23 disengage from the arcuate portions 222 of the burglarproof plate 22. Accordingly, distal ends of the legs 221 of the burglarproof plate 22 is moved to the position that prevents retraction of the latch bolt 31, thereby achieving the burglarproof function since the latch bolt 31 cannot be damaged by means of forcibly pressing the latch bolt 31 inward. In addition, the latch bolt 31 exposed outside may bear larger external impact without the risk of deformation as a result of provision of the reinforcing plate 33 mounted between the latch bolt 31 and the transmission member 32.

According to the above description, it is appreciated that assembly of the latch bolt 31 and the transmission member 32 is convenient and the resultant structure is stronger without the risk of disengagement therebetween. In addition, deformation of the latch bolt is avoided since the latch bolt and the transmission member are durable to larger impact after assembly.

Although the invention has been explained in relation to its preferred embodiment, it is to be understood that many other possible modifications and variations can be made without departing from the spirit and scope of the invention as hereinafter claimed.

What is claimed is:

1. A latch bolt assembly of a lock, comprising:

a casing;

a transmission device mounted in the casing; and a latch bolt device including a latch bolt, a transmission member having a first end with a hook thereon and a second end actuatable by the transmission device, and a substantially planar reinforcing plate, the latch bolt including a cavity for receiving the first end of the transmission member, the latch bolt further including a side opening for engaging with the hook of the transmission member to thereby couple the latch bolt to the transmission member to move therewith, the substantially planar reinforcing plate being inserted into the cavity to fill a spacing between the transmission member and the latch bolt, thereby securely retaining the first end of the transmission member in the cavity of the latch bolt.

2. The latch bolt assembly of a lock as claimed in claim 1, wherein the reinforcing plate is arranged in the cavity substantially parallel to and in abutment with said transmission member.

3. The latch bolt assembly of a lock as claimed in claim 2, wherein the reinforcing plate includes a protrusion for tightly and elastically positioning the transmission member in the cavity.

4. A latch bolt assembly of a lock, comprising:

a casing;

a transmission device mounted in the casing; and a latch bolt device including a latch bolt, a transmission member having a first end engaged with the latch bolt to move therewith and a second end actuatable by the transmission device, a substantially planar reinforcing plate for maintaining the transmission member in engagement with the latch bolt, wherein the transmission device further includes a safety mechanism mounted near the latch bolt, wherein the safety mechanism is biased inward for preventing retraction of the latch bolt when a door to which the lock is mounted is in a closed position; and wherein the safety mechanism includes a safety rod mounted juxtaposed to the latch bolt, a burglarproof plate having a first end securely mounted in the casing, an arcuate portion, and a free end, said mechanism further including an unlatching plate having a first end connected to the safety rod to move therewith and a second end operably connected to the arcuate portion of the burglarproof plate, and an elastic member mounted between the safety rod and the burglarproof plate for biasing the safety rod out of the door and for biasing the free end of the burglarproof plate out of a retraction path of the latch bolt in cooperation with the unlatching plate when the door is in an opened position, wherein the free end of the burglarproof plate is biased for preventing retraction of the latch bolt when the door is in the closed position.

5. The latch bolt assembly of a lock as claimed in claim 4, wherein the transmission member includes a hook on the first end thereof, the latch bolt including a cavity for receiving the first end of the transmission member, the latch bolt further including a side opening for engaging with the hook of the transmission member to thereby couple the latch bolt to the transmission member to move therewith, and wherein said reinforcing plate is inserted into the cavity to fill a spacing between the transmission member and the latch bolt, thereby securely retaining the first end of the transmission member in the cavity of the latch bolt.

6. The latch bolt assembly of a lock as claimed in claim 5, wherein the reinforcing plate is arranged in the cavity substantially parallel to and in abutment with said transmission member.

7. The latch bolt assembly of a lock as claimed in claim 6, wherein the reinforcing plate includes a protrusion for tightly and elastically positioning the transmission member in the cavity.

8. The latch bolt assembly of a lock as claimed in claim 4, wherein the reinforcing plate is arranged in a cavity in the latch bolt substantially parallel to and in abutment with said transmission member.

9. The latch bolt assembly of a lock as claimed in claim 8, wherein the reinforcing plate includes a protrusion for tightly and elastically positioning the transmission member in the cavity.

10. A latch bolt assembly of a lock, comprising:

a casing;

a transmission device mounted in the casing; and a latch bolt device including a latch bolt, a transmission member having a first end engaged with the latch bolt to move therewith and a second end actuatable by the transmission device, a substantially planar reinforcing plate for maintaining the transmission member in engagement with the latch bolt, wherein the transmission device further includes a safety mechanism mounted near the latch bolt, wherein the safety mechanism is biased inward for preventing retraction of the latch bolt when a door to which the lock is mounted is in a closed position; and wherein the transmission member includes a hook on the first end thereof, the latch bolt including a cavity for receiving the first end of the transmission member, the latch bolt further including a side opening for engaging with the hook of the transmission member to thereby couple the latch bolt to the transmission member to move therewith, and wherein said reinforcing plate is inserted into the cavity to fill a spacing between the transmission member and the latch bolt, thereby securely retaining the first end of the transmission member in the cavity of the latch bolt.

11. The latch bolt assembly of a lock as claimed in claim 10, wherein the reinforcing plate is arranged in the cavity substantially parallel to and in abutment with said transmission member.

12. The latch bolt assembly of a lock as claimed in claim 11, wherein the reinforcing plate includes a protrusion for tightly and elastically positioning the transmission member in the cavity.

13. A latch bolt assembly of a lock, comprising:

a casing;

a transmission device mounted in the casing; and a latch bolt device including a latch bolt, a transmission member having a first end engaged with the latch bolt to move therewith and a second end actuatable by the transmission device, a substantially planar reinforcing plate for maintaining the transmission member in engagement with the latch bolt, wherein the transmission device further includes a safety mechanism mounted near the latch bolt, wherein the safety mechanism is biased inward for preventing retraction of the latch bolt when a door to which the lock is mounted is in a closed position; and wherein the reinforcing plate is arranged in a cavity in the latch bolt substantially parallel to and in abutment with said transmission member.

14. The latch bolt assembly of a lock as claimed in claim 13, wherein the reinforcing plate includes a protrusion for tightly and elastically positioning the transmission member in the cavity.

* * * * *